United States Patent [19]

Collier

[11] Patent Number: 5,039,093

[45] Date of Patent: Aug. 13, 1991

[54] TOE EXERCISE DEVICE

[76] Inventor: Duane A. Collier, R.R. #1, Box 514-C, Cloverdale, Ind. 46120

[21] Appl. No.: 528,540

[22] Filed: May 25, 1990

[51] Int. Cl.[5] ..... A63B 21/02; A63B 23/04; A61H 1/02

[52] U.S. Cl. ..... 272/139; 272/137; 272/96; 128/25 B; 128/81 R

[58] Field of Search ..... 128/25 B, 26, 81 R, 128/880; 272/96, 137–139, 67, 142, 43, 116, 125, 126, 135, 143

[56] References Cited

U.S. PATENT DOCUMENTS

| | | | |
|---|---|---|---|
| 494,197 | 3/1893 | Hall | 128/26 |
| 667,338 | 2/1901 | Rogers | 128/880 |
| 1,126,938 | 2/1915 | Barnett | 128/26 |
| 1,373,211 | 3/1921 | Tanner | 128/81 R |
| 1,607,538 | 11/1926 | Hoffmann | 128/880 |
| 2,146,933 | 2/1939 | Budin | 128/81 R |
| 2,596,038 | 5/1952 | Mayer | 128/81 R |
| 2,688,961 | 9/1954 | Thomas | 128/880 |
| 3,063,446 | 11/1962 | Levitt | 128/81 R |
| 4,033,580 | 7/1977 | Paris | 272/137 |
| 4,869,499 | 9/1989 | Schiraldo | 279/96 |

FOREIGN PATENT DOCUMENTS

| | | | |
|---|---|---|---|
| 486552 | 4/1918 | France | 128/26 |
| 68844 | 12/1913 | Switzerland | 272/67 |

*Primary Examiner*—Richard J. Apley
*Assistant Examiner*—Karan G. Horowitz
*Attorney, Agent, or Firm*—H. Jay Spiegel

[57] ABSTRACT

An exercise device includes an elongated flexible body having an opening at one end designed to fit over one's leg above the knee. The device includes, at another end, a plurality of attachment devices, one for each of the toes of the user. The attachment devices are made of a woven material designed to contract radially as they are stretched longitudinally so that their connection over the respective toes is maintained as the device is stretched. The device is designed to be used to exercise one's toes.

8 Claims, 2 Drawing Sheets

TOE EXERCISE DEVICE

BACKGROUND OF THE INVENTION

The present invention relates to a toe exercise device. In the prior art, exercise devices designed to be used in conjunction with the legs and/or feet of the user are known. Furthermore, devices designed to be attached between the foot of the user and an area of the leg above the knee thereof are known, as taught by U.S. Pat. No. 4,209,012 to Smucker. In the Smucker device, however, the intent is to maintain the knee at a stationary predetermined degree of flexion for a desired time interval. There is no teaching or suggestion of interaction of the device between the upper leg and the toes of the user to allow toe exercises to be performed.

Furthermore, devices made of a woven material and designed to contract radially when they are stretched longitudinally are known in the prior art, as taught by U.S. Pat. No. 2,688,961 to Thomas. Such devices have been referred to in the art as "Chinese handcuffs". The Thomas device is designed to be used to inhibit thumb-sucking and includes a loop portion 14 in the nature of a teething ring having a pliant, plastic covering material 12 thereover. There is no teaching or suggestion in Thomas of an elongated resilient portion between the finger attachment portion and the loop, nor is there any teaching or suggestion in Thomas of the use of the device for the purposes set forth herein.

SUMMARY OF THE INVENTION

The present invention relates to a toe exercise device. The present invention includes the following interrelated objects, aspects and features:

(a) In a first aspect, the inventive device includes an elongated resilient, stretchable body made of a material such as, for example, rubber. At one end of the body, a ring-like structure is provided which is designed to stretch about the upper leg above the knee and to be retained there in light of the inherent resiliency thereof.

(b) At the other end of the elongated resilient body, a multiplicity of elongated finger-like structures are provided, one for each of the toes of the user.

(c) At an end of the elongated finger-like structures remote from the ring-like structure, each such elongated finger-like structure has a woven attachment device designed to contract radially as it is extended longitudinally. Such devices are known in the art as "Chinese handcuffs" and, as known, are designed to be placed over the finger of the user, whereupon when the user attempts to pull the device off the finger, such pulling action only tightens the handcuff about the finger. In order to remove the device from the finger, one must longitudinally compress the device to thereby expand it radially allowing removal. As applied in the present invention, these devices are sized and configured to fit over the respective toes of the user and, when extended longitudinally, are designed to contract about the respective toes of the user to retain the exercise device in position.

(d) With the inventive device placed with the ring-like structure above the knee of the user and with each of the five woven attachment devices mounted over the respective toes of the user, toe exercises may be performed by wiggling, extending and bending the toes so that the toes may be stretched, exercised and relaxed.

As such, it is a first object of the present invention to provide a toe exercise device.

It is a further object of the present invention to provide such a device including an elongated resilient body having attachment means at each end thereof.

It is a yet further object of the present invention to provide such a device wherein the attachment means for the toes are designed to contract radially when they are extended longitudinally.

These and other objects, aspects and features of the present invention will be better understood from the following detailed description of the preferred embodiments when read in conjunction with the appended drawing figures.

SPECIFIC DESCRIPTION OF THE PREFERRED EMBODIMENT

Figure 1:
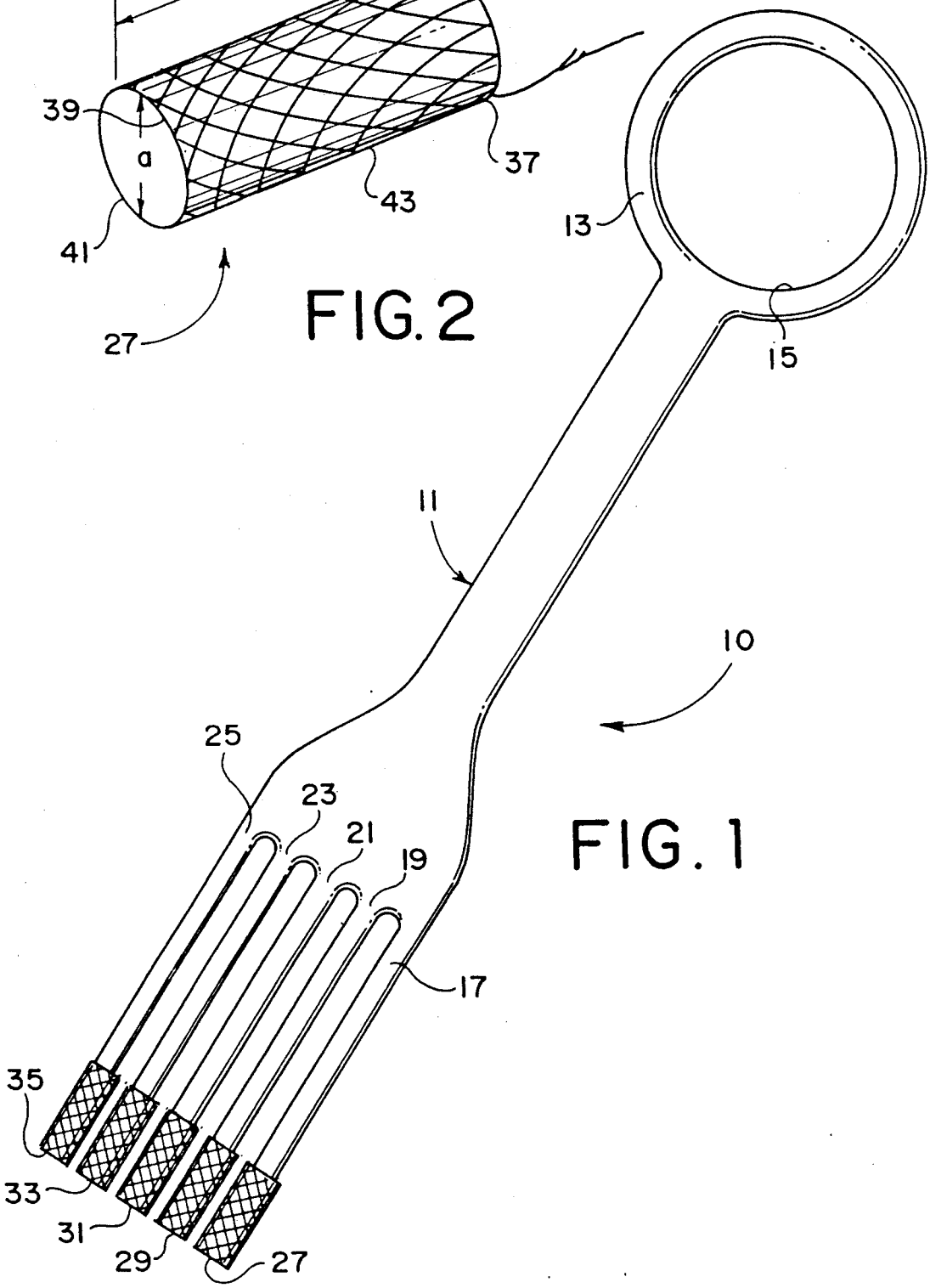
FIG. 1 shows a top view of the present invention.

With reference, first, to FIG. 1, the present invention is generally designated by the reference numeral 10 and is seen to include an elongated body 11 made of a resilient, stretchable material such as, for example, rubber. At one end of the elongated resilient body 11, a ring-like structure 13 is formed which includes an opening 15. The ring-like structure 13 is integral with the elongated resilient body 11 so that the opening 15 may be suitably stretched to accommodate to legs of differing sizes.

At the other end of the elongated resilient body 11, a multiplicity of elongated finger-like structures are provided and are designated by the respective reference numerals 17, 19, 21, 23 and 25. Each of these elongated finger-like structures is provided for one of the toes of the user. Thus, the elongated finger-like structure 17 is provided for the "big toe" of the user, and so on.

Each of the elongated finger-like structures has an end distal with respect to the ring-like structure 13. At each of these distal ends, a woven attachment device is attached. These woven attachment devices are designated by the reference numerals 27, 29, 31, 33 and 35.

Figure 2:
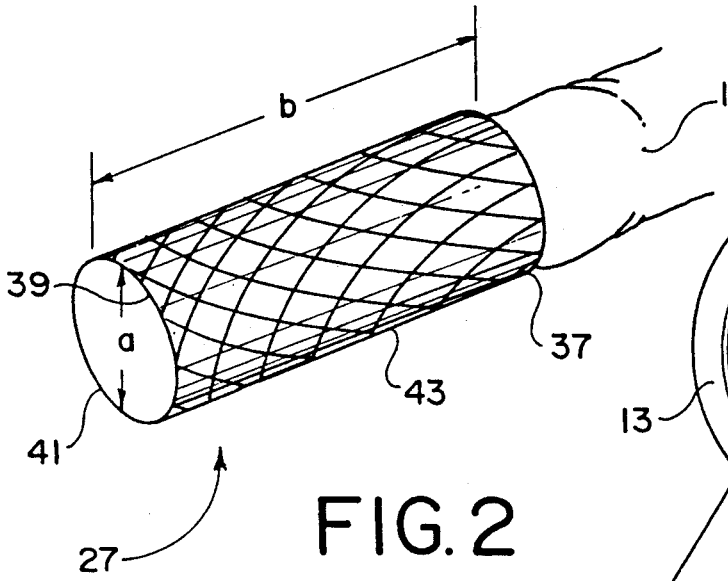
FIG. 2 shows a close-up view of one of the woven attachment devices of the present invention.

With reference to FIG. 2, the specific details of each woven attachment device are explained with reference to the woven attachment device 27. The woven attachment device 27 includes a connection location 37 where it is attached to the elongated finger-like structure 17 in any suitable manner. The woven attachment device 27 is generally cylindrical in shape having an internal chamber 39 accessed by an opening 41. The opening 41 has a diameter "a" and the woven attachment device 27 has a length "b". The woven attachment device 27 is formed by weavings 43 overlapping one another and making an oblique angle with respect to the longitudinal extent of the device 27.

As should be understood by those skilled in the art, as the woven attachment device 27 is stretched so as to increase the length of the dimension "b", such stretching will result in reduction in the diameter "a" of the opening 41 thereof, as well as over the entirety of the length thereof. Thus, with the device 27 mounted over the big toe of the user, stretching of the device 27 will cause reduction in the diameter "a" of the opening 41 as well as of the entire length of the device 27 to cause the device 27 to lock itself in position on the big toe of the user. In order to remove the device 27 from the big toe of the user, the device must be contracted longitudinally so as to make the dimension "b" shorter so as to thereby increase the diameter "a" of the opening 41 thereof as well as of the entirety of the length thereof to cause the device 27 to assume a diameter larger than that of the big toe to facilitate removal.

The above-described explanation of the structure and operation of the device 27 directly corresponds to the structure and function and operation of the woven attachment devices 29, 31, 33, 35. In each case, the woven attachment device is sized and configured so as to properly operate as described above in conjunction with the particular toe with which it is associated.

Figure 3:
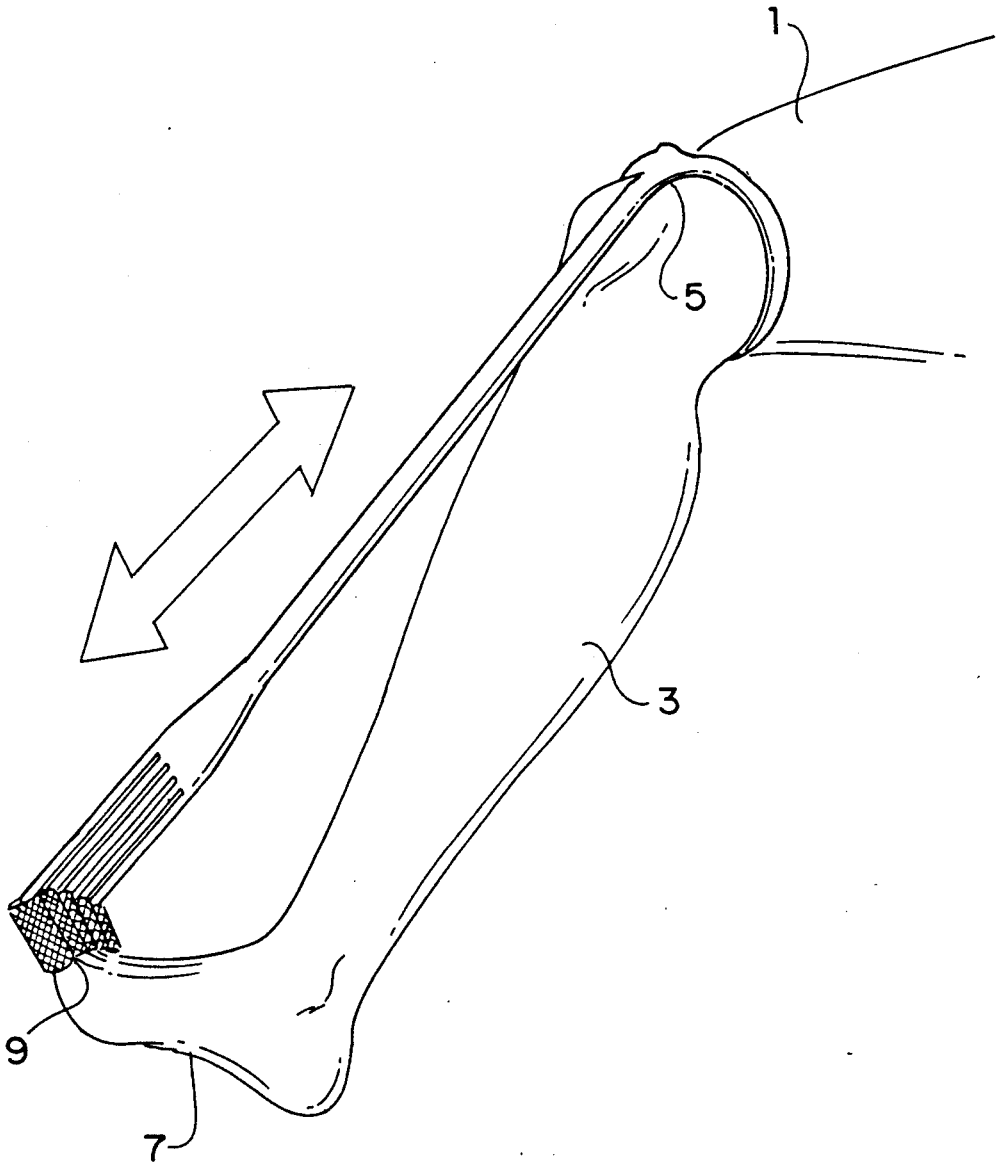
FIG. 3 shows a side view of the inventive toe exercise device as installed on the leg of the user.

With reference to FIG. 3, the manner of operation of the present invention will now be explained.

As shown, the user has an upper leg 1, a lower leg 3, a knee 5, a foot 7, and toes thereon of which the big toe 9 is particularly shown.

In the operation of the present invention, the opening 15 in the ring-like structure 13 is stretched so that it may be slipped over the foot 7 over the lower leg 3 and over the knee 5, whereupon it may be relaxed to grip the lower portion of the upper leg 1. With the elongated resilient body 11 draped over the knee 5 and down to the foot 7, the individual woven attachment devices 27, 29, 31, 33 and 35 are placed over the respective toes of the foot 7. In this orientation, the elongated resilient body 11 should be slightly stretched so that the woven attachment devices are extended longitudinally and contracted radially so that they grip their respective toes. The position of the ring-like structure 13 may be adjusted on the upper leg 1 to provide this slightly stretched configuration.

With the inventive device 10 so attached to the leg and toes of the user, various exercises may be performed including flexing of the lower leg 3 with respect to the upper leg 1, wiggling, bending and other movements of the individual toes.

When it is desired to remove the inventive device 10 from the leg and toes of the user, the ring-like structure 13 is slipped below the knee 5 to sufficiently loosen the woven attachment devices so that their lengths are contracted and their diameters are increased to allow removal from the individual toes of the user.

As such, an invention has been disclosed in terms of a preferred embodiment thereof which fulfills each and every one of the objects of the invention as set forth hereinabove and provides a new and improved toe exercise device of great novelty and utility.

Of course, various changes, modifications and alterations in the teachings of the present invention may be contemplated by those skilled in the art without departing from the intended spirit and scope of the present invention. As such, it is intended that the present invention only be limited by the term of the appended claims.

I claim:

1. An article of manufacture, comprising:

(a) an elongated stretchable one piece body;

(b) one end of said body being formed into a ring-like structure having a stretchable opening;

(c) another end of said body being formed into a plurality of finger-like structures;

(d) each of said finger-like structures having an end having attached thereto a proximal closed end of a generally cylindrical device having an opening distal from a respective said finger-like structure and an internal chamber, which device, when extended longitudinally, contracts radially.

2. The invention of claim 1, wherein said body is made of rubber.

3. The invention of claim 1, wherein each of said generally cylindrical devices is woven.

4. The invention of claim 1, wherein said plurality of finger-like structures comprises five finger-like structures.

5. An exercise device, comprising:

(a) an elongated one piece body having one end being formed into a ring-like structure having a stretchable opening;

(b) another end of said body being formed into a plurality of finger-like structures, each of which having attached thereto at an end thereof a closed end of attachment means for direct attachment around and engagement with a toe of a user via a distal opening of said attachment means;

(c) said stretchable opening being stretchable to allow placement of said ring-like structure on an upper leg of a user above a knee thereof, with said attachment means being attached and locked over respective toes of a user whereby exercises may be performed.

6. The invention of claim 5, wherein said body is made of rubber.

7. The invention of claim 5, wherein each of said attachment means comprises a woven generally cylindrical device having an opening distal from a respective said finger-like structure and an internal chamber.

8. The invention of claim 5, wherein said plurality of finger-like structures comprises five finger-like structures, one for each toe of a user.

* * * * *